United States Patent [19]

Morse

[11] Patent Number: 4,741,392

[45] Date of Patent: May 3, 1988

[54] SECTIONAL CORE RADIATOR

[75] Inventor: James D. Morse, Racine, Wis.

[73] Assignee: Modine Manufacturing Company, Racine, Wis.

[21] Appl. No.: 946,022

[22] Filed: Dec. 24, 1986

[51] Int. Cl.[4] ..... F28F 7/00; F28F 9/26

[52] U.S. Cl. ..... 165/76; 165/144

[58] Field of Search ..... 165/76, 144

[56] References Cited

U.S. PATENT DOCUMENTS

| | | | |
|---|---|---|---|
| 962,189 | 6/1910 | Behringer | 165/76 |
| 1,354,341 | 9/1920 | Rossi | 165/76 |
| 1,387,755 | 8/1921 | Beam | 165/76 |
| 1,398,176 | 11/1921 | Conlon | 165/76 |
| 1,416,945 | 5/1922 | Chardard | 165/151 |
| 1,433,398 | 10/1922 | Modine | 165/151 |
| 1,441,034 | 1/1923 | Schulz | 165/173 |
| 1,514,463 | 11/1924 | Rossi | 165/76 |
| 1,520,837 | 12/1924 | Morgan | 165/151 |
| 1,813,221 | 7/1931 | Young | 165/144 |
| 2,037,845 | 4/1936 | Young | 165/139 |
| 2,099,186 | 11/1937 | Anderegg | 165/110 |
| 2,108,223 | 2/1938 | Young | 165/139 |
| 2,240,537 | 5/1941 | Young | 165/83 |
| 2,308,119 | 1/1943 | Spieth | 165/83 |
| 2,816,739 | 12/1957 | Stoehr | 165/83 |
| 3,096,818 | 7/1963 | Evans et al. | 165/111 |
| 3,415,315 | 12/1968 | Donaldson et al. | 165/148 |
| 3,447,603 | 6/1969 | Jones | 165/178 |
| 4,044,443 | 8/1977 | Chartet | 29/157.4 |
| 4,159,035 | 6/1979 | Chartet | 165/173 |
| 4,236,577 | 12/1980 | Neudeck | 165/175 |
| 4,344,478 | 8/1982 | Petaja et al. | 165/69 |
| 4,485,867 | 12/1984 | Melnyk et al. | 165/173 |
| 4,553,586 | 11/1985 | Lardner | 165/76 |

FOREIGN PATENT DOCUMENTS

| | | | |
|---|---|---|---|
| 140913 | 4/1980 | Fed. Rep. of Germany | 165/76 |
| 46721 | 8/1936 | France | 165/76 |
| 68088 | 8/1913 | Switzerland | 165/76 |
| 14440 | of 1913 | United Kingdom | 165/76 |

*Primary Examiner*—Albert W. Davis, Jr.
*Assistant Examiner*—Richard R. Cole
*Attorney, Agent, or Firm*—Wood, Dalton, Phillips, Mason & Rowe

[57] ABSTRACT

Radiator core modules are connected to a radiator frame and establish communication between spaced inlet and outlet manifold tanks on the frame by means of first cooperating male and female elements provided on a core module and one of the manifold tanks to establish communication between the one manifold tank and module upon the module and one manifold tank being moved against each other in a first direction and by second cooperating male and female elements provided on the module and the other of the manifold tanks to establish communication therebetween upon the module and other manifold tank being moved against each other in a second direction that is transverse to the first direction.

12 Claims, 3 Drawing Sheets

FIG. 1
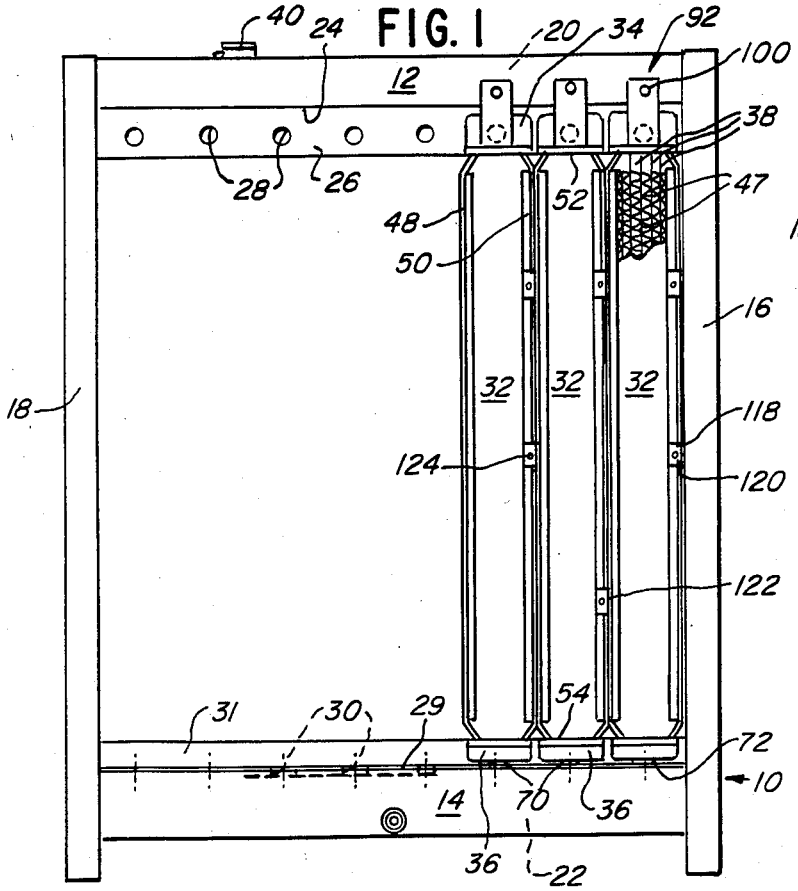
FIG. 10
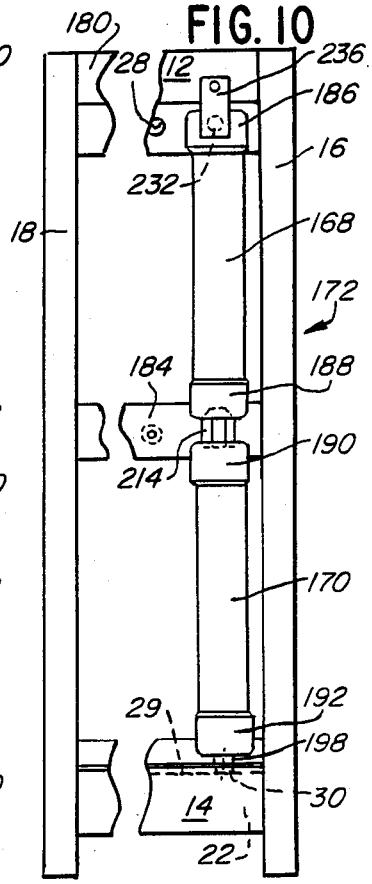
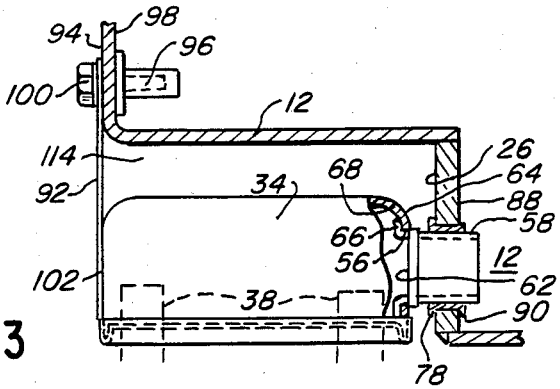
FIG. 3
FIG. 4
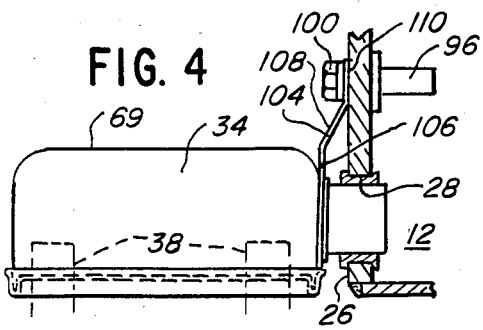
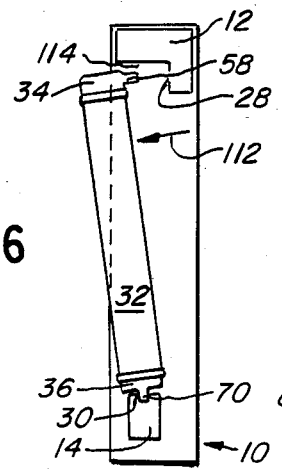
FIG. 6
FIG. 5
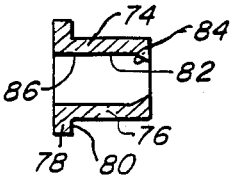
FIG. 7
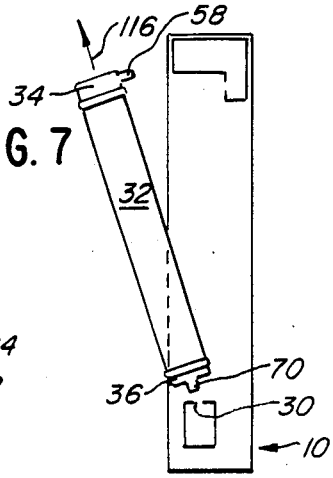

FIG. 2
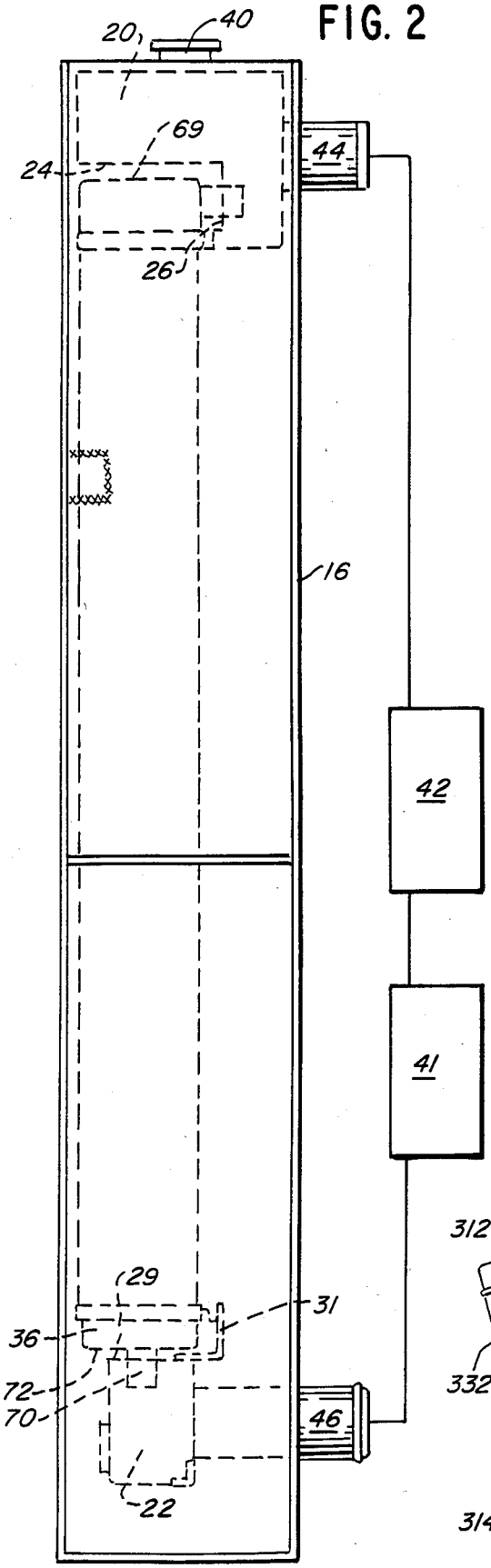
FIG. 11
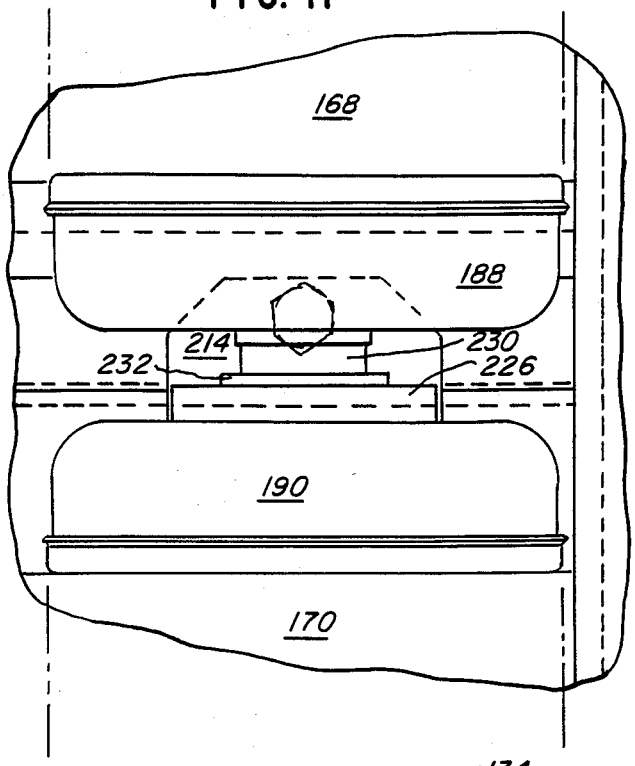
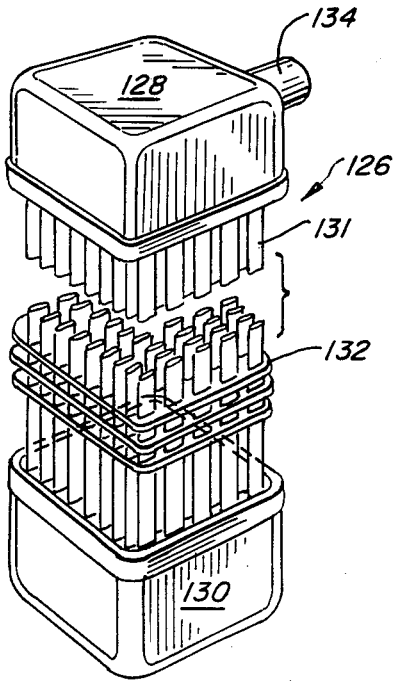
FIG. 9
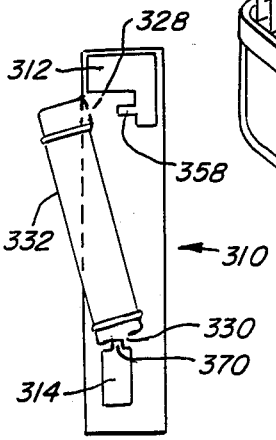
FIG. 13

SECTIONAL CORE RADIATOR

BACKGROUND OF THE INVENTION

1. Field of the Invention

This invention relates to heat exchangers and, more particularly, to structure for sealingly mounting modular cooling cores on a radiator frame.

2. Background Art

It is known to construct heat exchangers, such as radiators used with internal combustion engines, with modular cooling cores communicating between inlet and outlet manifold tanks. The modular construction is preferred to a single piece core construction particularly in high stress environments, because it is more durable than a radiator with a one piece core, and in environments where physical damage to the core section is likely.

The principal advantage with the modular construction is that one need only remove and replace or repair the damaged core module, leaving the remaining modules in place. The individual core modules can be easily removed and replaced at a relatively modest cost, whereas damage to a portion of a single piece core may require removal and replacement of the entire core section. This is time consuming and costly.

In the event that a core module is damaged and a replacement is not readily available, the ports in the defective core module can be plugged, with the module reinstalled, to continue operation of the engine at partial load (depending on ambient temperature) until a replacement can be procured.

A further advantage of the modular construction is that the core modules have some inherent flexibility on the radiator frame and will absorb shock and accommodate twisting and thermal expansion better than a single piece core is capable of doing.

Some conventional core sections have upper and lower collecting tanks connecting to the inlet manifold tank and outlet manifold tank, respectively, through projecting tubes which are sealingly accepted in ports in the manifold tanks. Heretofore, relatively complicated structures have been used to mount the core modules on the radiator frame.

One example of a prior art structure is shown and described in U.S. Pat. No. 1,354,341, to Rossi. In Rossi, core modules are provided with upper and lower rearwardly projecting nipples which are extended through ports in spaced manifold tanks. With the nipples and ports aligned, each module is pressed towards the tanks to compress the nipples sealingly in the ports. A strap and bolt are used at both the upper region and lower region of each core module to prevent the nipples from escaping from their respective tank ports.

It is also known to have inlet and outlet tubes on core modules that are in axial alignment with each other, such as those shown in U.S. Pat. No. 4,236,577, to Nendeck. In Nendeck, each module has an elongate cylindrical configuration with reduced diameter ends for reception in axially aligned ports on spaced manifold tanks associated with a frame. One of the reduced diameter ends is sufficiently long that it can be directed vertically through one port in the frame, with the module slightly tilted, far enough to allow the core module to be reoriented to align the lower end over the other port. The module is shifted axially to seal its other end. A substantial amount of space is required over the top frame port to permit the required penetration by the one module end. Further, a substantial length of the core has the reduced diameter to permit passage through the one port, and this may undesirably limit flow volume and heat exchange surface area.

As an alternative to assembling core modules with axially aligned inlet and outlet tubes according to Nendeck, the inlet manifold tank can be built around the core modules that are already in place on the outlet manifold tank. This, however, complicates assembly and disassembly of the core modules. Some of the benefits of the modular core construction would therefore not be realized.

SUMMARY OF THE INVENTION

The present invention is specifically directed to overcoming the above enumerated problems in a novel and simple manner. The invention describes a radiator which need not be disassembled or removed from its installation in order to service it by replacing or repairing damaged core modules. Additionally, the invention has features which eliminate assembly and thermal stress in the core modules, thereby increasing durability.

According to the invention, improved structure is provided for connecting core modules to a radiator frame to establish communication between spaced inlet and outlet manifold tanks on the frame. First cooperating male and female elements are provided on a core module and one of the manifold tanks to establish communication between the one manifold tank and module upon the module and one manifold tank being moved against each other in a first direction. Second cooperating male and female elements are provided on the module and the other of the manifold tanks to establish communication therebetween upon the module and other manifold tank being moved against each other in a second direction that is transverse to the first direction.

In a preferred form, the outlet manifold tank has a port to sealingly accept a tube on the lower portion of the core module upon the module being moved downwardly relative to the outlet tank. The upper portion of the module has a horizontally projecting tube which is sealingly engaged in a port on the inlet manifold tank upon the tube being directed horizontally and rearwardly into the inlet tank port with the one tube already seated in the outlet tank port.

The module tubes cooperate with each other to maintain the core in position on the radiator frame. As long as the upper tube remains within its associated port, the lower tube cannot separate from the outlet tank. To assure that the upper tube remains in place, a strap on the module is attached to the inlet tank to block the upper module portion against pivoting movement away from the frame with the upper tube in the inlet tank port.

Accordingly, all the advantages of the modular core construction are realized with the inventive structure and assembly of the core modules is simplified over the aforementioned prior art structures. Assembly of the individual cores involves simply tilting the upper portion of the module slightly forwardly away from the frame and introducing the bottom tube into a port in the outlet tank. Upon the bottom tube being fully seated, the upper portion of the module can be pushed rearwardly to its vertical position which seats the upper tube in the port in the inlet tank. Disassembly involves reversal of the assembly steps.

In a preferred form of the invention, rubber grommets are provided in each of the tank ports to sealingly surround the tubes. The modules are effectively supported from the frame on rubber and thus are positively sealingly connected yet a modicum of shifting relative to the radiator frame is permitted. The core sections are isolated from shock by the grommets and the tube on the lower portion of the core module can move up and down in its sealing rubber grommet to accommodate thermal expansion and assembly variations.

BRIEF DESCRIPTION OF THE DRAWINGS

FIG. 1 is a front elevation view of a radiator with a frame and some core sections assembled to the frame using serpentine fin core modules according to the present invention;

FIG. 2 is a side elevation view of the radiator in FIG. 1;

FIG. 3 is an enlarged, fragmentary view of structure for holding the top portion of each core module against the radiator frame;

FIG. 4 is a view similar to that in FIG. 3 with an alternative type of structure for holding the top portion of each module against the frame;

FIG. 5 is a sectional view of a resilient grommet used to seal the connection between inlet and outlet tubes on the modules and the radiator frame;

FIG. 6 is a schematic representation of the frame and core module according to the invention with the upper portion of the core module pivoted away from the frame to disassemble the module; and FIG. 7 is a view similar to that in FIG. 6 with the core module separated from the frame;

FIG. 9 is a perspective view of a partially assembled plate fin core module according to the present invention;

FIG. 10 is a fragmentary, front elevation view of a radiator frame with one assembled pair of vertically stacked core modules according to the present invention;

FIG. 11 is an enlarged, fragmentary, front elevation view of a connection between the stacked core modules of FIG. 10;

FIG. 13 is a view of a radiator frame and module similar to that in FIG. 6 with inlet and outlet tubes on the radiator frame.

DESCRIPTION OF THE PREFERRED EMBODIMENTS

Figure 12:
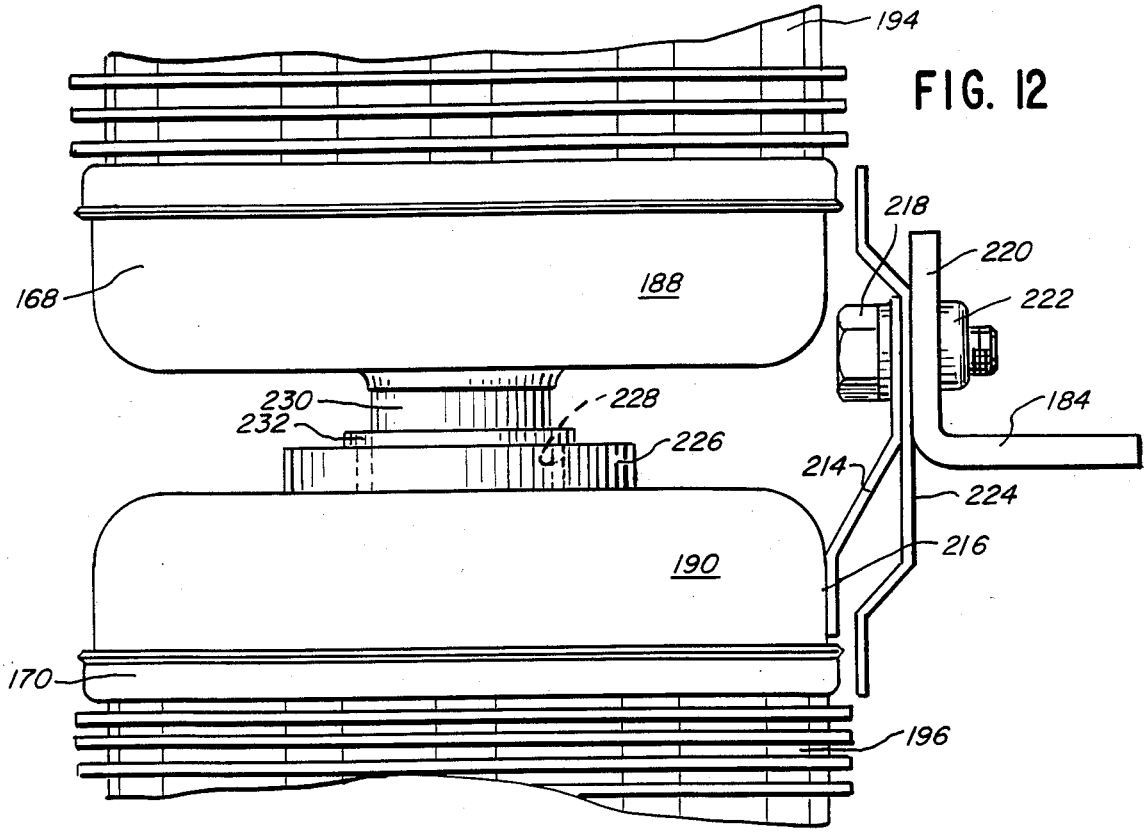
FIG. 12 is an enlarged, fragmentary, side elevation view of the core module connection of FIG. 11.

A partially completed radiator according to the present invention is shown in FIGS. 1 and 2. The radiator comprises a rigid frame 10 having an upper, inlet manifold tank 12, a bottom, outlet manifold tank 14 and spaced, upright side frame members 16, 18. The tanks 12, 14 are preferably constructed from steel and define fluid retaining chambers 20, 22, respectively, whose ends are sealed by the side frame members 16, 18.

The inlet manifold tank 12 has an inverted L-shaped configuration in cross section and has a downwardly facing surface 24 and a rearwardly recessed forwardly facing wall 26. A plurality of ports 28, on evenly spaced centers, extend through the wall 26 on the inlet tank 12.

The outlet manifold tank 14 has a generally rectangular configuration in cross section with an upwardly facing wall 29 having ports 30, equal in number to the openings 28 in the inlet tank, and in vertical alignment therewith. An air baffle 31 is mounted to the upper wall 29 and spans the distance between the side frame members 16, 18. In the depicted embodiment eight ports are provided in each of the tanks 12, 14, to accommodate an equal number of core modules 32, which are on the order of $4\frac{1}{2}$ inches in width.

Each module 32 has an upper collection tank 34 and a lower collection tank 36. In each module 32, a plurality of spaced, oval tubes 38 in one or more rows communicate between the upper and lower tanks 34, 36. The upper tank 34 is connected to the frame 10 for communication with the manifold tank chamber 20 and the lower collection tank 36 is connected to the frame 10 for communication with the lower manifold tank chamber 22 by structure that will be described in detail below.

Briefly, the general operation of the cooling system is as follows. A cooling fluid is introduced to the system through a filler neck 40 on the inlet manifold tank 12. The coolant is circulated in the system, which typically includes an engine 41, by a pump 42 (FIG. 2). The pump delivers high temperature coolant to the inlet tank chamber 20 through an inlet port 44 on the tank 12. The coolant circulates through the tubes 38 in the core modules 32 and flows into the outlet tank chamber 22 and from there exits through an outlet port 46 on the manifold tank 14 for delivery to the engine 41 to effect cooling thereof through heat exchange.

The core modules 32 dissipate heat from the coolant that is circulated through the tubes 38 in the core. In the depicted embodiment, multiple rows of vertical tubes are provided in each module for communication between the collection tanks 34, 36. Two or more rows or tubes 38 may be provided. A serpentine arrangement of fins 47 is attached to each tube to increase the surface area for heat dissipation. Core side members 48, 50 maintain the assembly of tubes 38 and fins 47 in each core module 32 closely together to define a rigid, unitary core.

Preferably, the tubes 38 are made from brass, as is the bottom wall 52 of the upper collection tank 34 and the top wall 54 of the lower collection tank 36. The remainder of each tank 34, 36 is preferably constructed from steel.

The details of the connection between the core modules 32 and frame 10 are shown clearly in FIGS. 1–5. The upper collection tank 34 on each module has an opening 56 which accepts an inlet tube 58, that is preferably constructed from brass. The tube 58 has a radially enlarged, annular shoulder 62, which abuts a rearwardly facing surface 64 on the tank 34 with the tube 58 fully seated in the opening 56. To secure the tube 58 a portion 66 thereof within the collection tank is turned radially outwardly and secured as by soldering to the inside surface 68 of the tank 34 to make a fluid tight connection.

The lower collection tank 36 has an outlet tube 70 having substantially the same configuration as the inlet tube 58 and is secured in similar fashion to the bottom wall 72 of the collection tank 36 in a port.

Assembly of each module 32 is initiated by first tilting the core and locating the outlet tube 70 over an opening in rubber grommet 74 in a port 30 in the manifold tank 14. Downward movement of the module 32 in the FIG. 6 position seats the tube 70 in the grommet 74. Once this position is realized, the upper portion of the core module 32 is pivoted rearwardly (clockwise in FIGS. 6 and 7) about the outlet tube 70 so that the outlet tube fully seats and inlet tube 58 aligns with the grommet 74 in port 28 and can be pressed therethrough. A slight clearance is maintained both between the upwardly facing surface 69 of tank 34 and the downwardly facing surface 24 on tank 12 and the downwardly facing surface 72 on the tank 36 and upwardly facing surface 29 on tank 14 to facilitate assembly and disassembly of the cores 32.

To seal the connection between the wall 26 and inlet tube 58 and the tube 70 and wall 30, a rubber grommet 74 is provided in each of the ports 28, 30. Each grommet comprises a cylindrical body 76 with an enlarged head 78 defining a shoulder 80, which abuts the surfaces 26, 29 with the grommets in the ports 28, 30 respectively. The grommet 74 has an axial bore 82 defining a passageway for the inlet tubes 58 and outlet tubes 70. At the end of the body 76 remote from the head 78, the core is restricted by a radially inwardly directed frusto-conical surface 84.

Prior to assembly of the core modules 32, the grommets 74 are inserted through the ports 28, 30. The tubes 58, 70 are then directed through the grommets 74 and each has a diameter slightly larger than the inside surface 86 bounding the bore 82 so that the grommets 74 are squeezed within their respective openings. Upon the tubes 58, 70 encountering the surface 84, the surface 84 is deformed radially outwardly. As seen clearly in FIGS. 3 and 4, the radius of the grommet is effectively enlarged at the rear surface 88 of the wall 26 to form a radially outwardly directed projection 90, which, in conjunction with the head 78 captures the wall 26 to maintain the grommet 74 in position. A similar connection is established between the grommets 74 and the wall 29.

To lock the modules into place, structure as shown in FIGS. 3 or 4 is utilized. In FIG. 3, a strap 92, having its lower end welded to the forwardly facing surface 102 of the collector tank 34, is attached to a forwardly facing surface 94 at the upper portion of the tank 12. A nut 96 is welded to the inside surface 98 of the tank 12 for threadably mating with a bolt 100 that is directed through the strap and the tank surface to secure the strap 92 in place.

As an alternative to the strap 92 in FIG. 3, a strap 104 is welded to the rearwardly facing wall 106 in FIG. 4 and has an offset portion 108 and a mounting leg 110, which seats facially against the wall 26 on the tank 12. A nut 96 cooperates with a bolt 100 to secure the strap leg 110 to the tank 12.

The straps 92, 104 block the escape of the tube 58 from the openings 28. As long as the tube 58 is in the opening 28, upward shifting of the core module is prohibited by the tube 58 within the opening 28.

To disassemble any one of the core modules 32, the strap 92, 104 is first released and the upper portion of the module 32 is tipped in the direction of arrow 112 in FIG. 6 sufficiently that the inlet tube 58 is disengaged from grommet 74 for some slight distance. Upon this occurring, the module is moved in the direction of arrow 116 in FIG. 7 to pull the tube 70 from the grommet 74 and separate the module from the frame. If design is as per FIG. 3, there is clearance 114 (FIG. 3) provided so that module 32 can be moved in direction 116 for sufficient distance to disengage tube 70 from grommet 74.

The spatial relationship of the core module 32 and radiator frame 10 in FIG. 6 and FIG. 7 is exaggerated for descriptive purposes.

To control lateral vibrations, L-shaped spacers 118 (FIG. 1) are attached to the core modules to close clearances which are necessary for assembly and disassembly of core modules. Each spacer comprises a first leg 120 and a second leg 122 which resides between the side members 48, 50 on adjacent core modules and maintains a slight spacing therebetween that is determined by the thickness of the second leg 122. An opening 124 is provided in each of the first legs 120 to facilitate assembly to the side members 48, 50.

Figure 8:
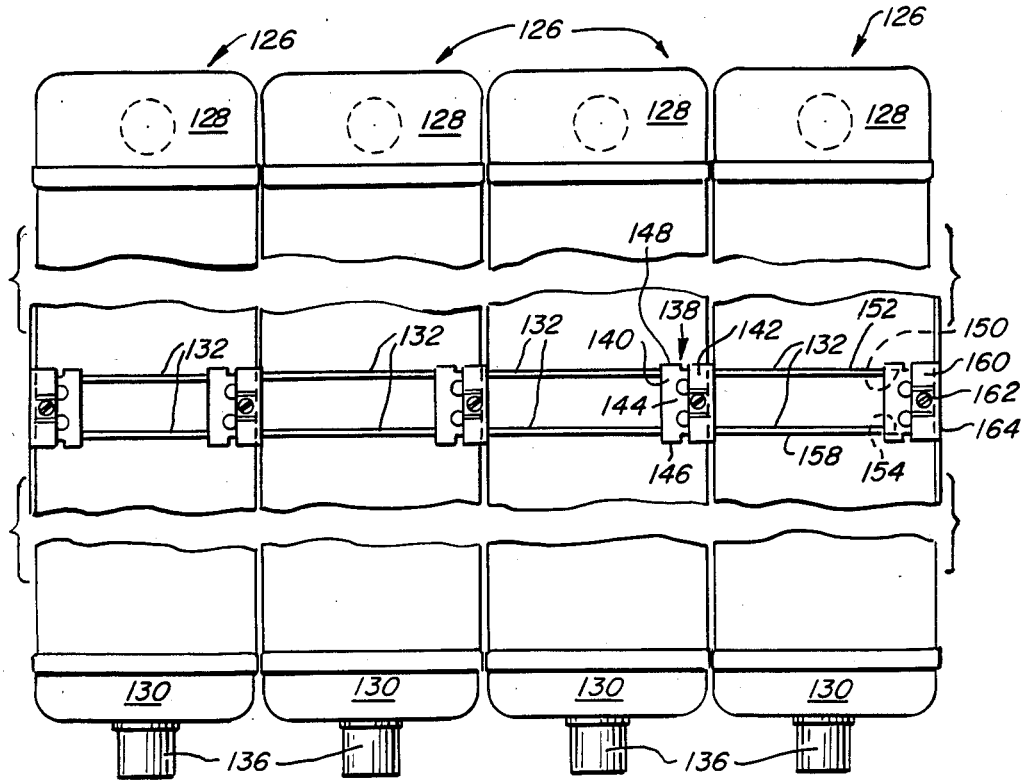
FIG. 8 is a front elevation view of a plurality of plate fin core modules according to the present invention arranged in side-by-side relationship.

While the invention has been described with core modules having serpentine fins, the invention also contemplates use of plate fin core modules as shown in FIGS. 8 and 9.

In FIG. 9, the details of a single core module at 126 are shown. The core module 126 comprises an upper collection tank 128 and a lower collection tank 130. Communication is established between the tanks 128, 130 by a plurality of vertically extending oval tubes 131. In the FIG. 9 configuration for the modules 126, five rows of tubes 131 are provided with nine tubes in each row. A stack of thin, horizontally oriented, flat metallic plate fins 132 are punched and frictionally accept the tubes 131. Heat from the tubes is conducted through the plate fins 132, which have a substantial surface area and thus efficiently dissipate heat. The plate fins 132 are closely, vertically spaced from each other throughout the height of the module 126 between the tanks 128, 130. Only three plate fins 132 are shown in FIG. 9 and the spacing therebetween is exaggerated for purposes of illustration.

Each core module 126 has a horizontal inlet tube 134 projecting from and in communication with the collection tank 128 and a vertical outlet tube 136 projecting from and in communication with the bottom collection tank 130 (FIG. 8). The modules 126 are assembled to a frame 10 such as that shown in FIG. 1 in substantially the same manner as the serpentine fin core modules 32. The assembled core modules 126 reside in side-by-side relationship as shown in FIG. 8.

To maintain a predetermined spacing between adjacent modules 126 and control lateral vibrations, spacers 138 are provided. Each spacer 138 comprises a bracket 140 and a clip 142 for connection thereto. The bracket 140 has a generally U shape with a body 144 and vertically spaced, aligned legs 146, 148 bent at right angles to the body 144. The spacing of the legs 146, 148 is such that the underside 150 of the upper leg 148 resides facially against an upwardly facing surface 152 on one of the plate fins 132 and the upwardly facing surface 154 of the bottom leg 146 resides facially against a downwardly facing surface 158 on another, lower plate fin 132. The clip 142 is L-shaped and has one leg 160 overlying and secured as by a screw 162 to the body 144 of the bracket 140 so that the other leg 164 resides between plate fins 132 on adjacent modules 126 and maintains a spacing between modules 126 equal to the thickness of the leg 164.

Various other arrangements of modules can be used consistently with the invention. For example, pairs of modules 168, 170 can be stacked vertically, one upon the other, between manifold tanks 12, 14, as shown in FIGS. 10-12. In these Figures, a plate fin core module construction is shown, however it should be understood that a serpentine fin core module could be used in the same manner.

In FIG. 10, two vertically stacked modules 168, 170 are shown connected to a frame 172 consisting of side frame members 16, 18 and inlet and outlet manifold tanks 12, 14 respectively, the same as on the frame in FIG. 1. Midway between the tanks 12, 14 a horizontal angle iron brace 184 is provided and rigidly attached at its ends to the side frame members 16, 18.

The upper module 168 has an upper collection tank 186 and lower collection tank 188. The lower module 170 has an upper collection tank 190 and a lower collection tank 192. Communication is established between the upper collection tank 186 and lower collection tank 188 on the upper module 168 by tubes 194 and tubes 196 establish communication between the tanks 190, 192 on the lower module 170.

The lower module 170 is first connected to the frame 172 and has a vertically oriented tube 198 depending from the tank 192. The tube 198 is directed through a port 30 in the wall 29 on the tank 14 to establish communication between the chamber 22 defined by the tank 14 and the tank 192. A grommet (not shown in FIG. 10) seals the connection between the tanks 14, 192. The upper tank 190 has a flat strap 214 secured to a rear wall 216 thereon. The strap 214 is secured as by a bolt 218 to a vertically extending leg 220 on the bracket 184. A weld nut 222 is attached to the leg 220 to facilitate assembly. A baffle 224 is interposed between the leg 220 of the bracket 184 and the strap 214. With the bolt 218 tightened, the module 170 and baffle 224 are positively held in place on the frame 172.

The top of tank 190 has a support block 226 with a vertical bore 228 therethrough to closely accept a vertical tube 230 projecting from the lower collection tank 188 on the module 168. A rubber grommet 232 is fit in the bore and makes close sealing connection between the tube 230 and block 226 in the same manner as the grommets 74, previously described.

The upper module 168 is assembled between the lower module 170 and tank 12 in the same manner as the modules 32 are assembled to the frame 10, as shown in FIGS. 6 and 7. With the module 168 tilted and the tube 230 extended into the bore 228, the top of the module 168 can be pivoted towards the tank 180 to seat a horizontally projecting tube 232 in a port 28 in the tank 12. A strap 236 is attached like the straps 92 to maintain the module 168 positively against the frame 172 and thereby prevent disengagement of the module 168.

Other variations are also within the scope of the invention. For example, it is also possible to provide more than one row of modules in a fore and aft direction on the frame.

Further, the locations of inlet tube 58 and the port 28, in which the tube 58 seats, and/or the outlet tube 70 and the port 30, within which the tube 70 seats, described above, can be reversed, as shown in FIG. 13. A radiator frame 310 is shown schematically with an intake manifold tank 312 and outlet manifold tank 314. Recesses 328, 330 are provided in the inlet and outlet sections, respectively, of each module 332. The module 332 is shown in a position relative to the frame 310 corresponding to the FIG. 6 position. Tubes 358, 370 are provided on the inlet tank 312 and outlet tank 314 to seat in the module recesses 328, 330, respectively.

To complete assembly of the module 332 and frame 310 in FIG. 13, the module 332 is urged downwardly to seat the tube 370 in the port 330 and thereafter the upper end of the module 332 is urged towards the right to seat the tube 358 in the port 328. Rubber grommets, as previously described, can be used to seal the connection between the tubes 358, 370 and ports 328, 330.

It can be seen that the core modules are readily assembled and disassembled and are positively, sealingly locked in place on the radiator frame. Further, the core modules are isolated from assembly stresses, destructive shock and thermal stresses as well as twisting forces on the radiator.

What is claimed is:

1. An improved cooling system of the type having an inlet manifold tank, an outlet manifold tank and at least one module with conduit means for establishing communication between the manifold tanks, the improvement comprising:

first cooperating male and female elements on the module and one of the manifold tanks for establishing communication between the one manifold tank and the conduit means upon said module and one manifold tank being moved against each other in a first direction; and second cooperating male and female elements on the module and the other of the manifold tanks for establishing communication between the other manifold tank and the conduit means upon said module and other manifold tanks being moved against each other in a second direction that is transverse to said first direction, whereby with the first and second cooperating male and female elements connected communication is established between the manifold tanks by said module.

2. The improved cooling system according to claim 1 wherein said first and second directions are at approximately 90° to each other.

3. The improved cooling system according to claim 1 wherein at least one of said first and second cooperating male and female elements comprises a port in one of the manifold tanks and module and a tube to fit within the port on the other of the manifold tanks and module.

4. The improved cooling system according to claim 3 wherein said port has a resilient grommet to sealingly surround the tube that is fit therewithin.

5. The improved cooling system according to claim 1 wherein means are provided on one of the manifold tanks to block movement of the module and thereby prevent disconnection of one of the first and second cooperating male and female elements and with the one of the first and second cooperating male and female elements blocked in connected relationship disconnection of the other of the first and second cooperating male and female elements is prohibited.

6. An improved cooling system of the type having an inlet manifold tank, an outlet manifold tank and at least one module with conduit means for establishing communication between the manifold tanks, said module having a front and rear, a top surface and a bottom surface, the improvement comprising:

a first tube on the module projecting below its bottom surface and in communication with the conduit means;

a second tube on the module projecting rearwardly therefrom and in communication with the conduit means;

first port means in the outlet manifold for receiving the first tube to establish communication between the outlet manifold tank and conduit means upon the first tube being directed downwardly into the first port means; and second port means in the inlet manifold tank for receiving the second tube to establish communication between the inlet manifold tank and conduit means upon the second tube being directed rearwardly into the second port means, whereby with the first and second tubes in the first and second port means communication is established between the manifold tanks through said module.

7. The improved cooling system according to claim 6 wherein said inlet manifold tank has a surface that faces the top surface of the module and the outlet tank has a surface that faces the bottom surface of the module and with the first and second tubes in the first and second port means, the top module surface is spaced from the facing inlet manifold surface and the bottom module surface is spaced from the facing outlet manifold surface to facilitate assembly and disassembly of the module.

8. The improved cooling system according to claim 6 wherein means are provided on the inlet manifold tank to block forward movement of an upper portion of the module with the second tube in the second port means and thereby prevent separation of the module from the inlet and outlet manifold tanks.

9. The improved cooling system according to claim 8 including at least a first and second module connected to the inlet and outlet manifold tanks and means are provided between the inlet and outlet manifold tanks for cooperating directly between the first and second modules to maintain a fixed relationship of the modules between the inlet and outlet manifold tanks.

10. The improved cooling system according to claim 8 wherein the blocking means comprises a strap on the module and means securing the strap to the inlet manifold tank.

11. A core module for establishing communication between spaced inlet and outlet tanks on a radiator frame, said core module comprising:

a first collecting tank;

a second collecting tank in spaced relationship to said first collecting tank;

means communicating between the first and second collecting tanks;

a first tube on one of the first and second collecting tanks and projecting from the one collecting tank in a first direction for establishing communication with one of the inlet and outlet tanks; and a second tube on the other of the first and second collecting tanks and projecting from the other collecting tank in a second direction that is transverse to the first direction for establishing communication with the other of the inlet and outlet tanks.

12. The core module according to claim 11 wherein said core module has a top and bottom and the first tube is directed horizontally for communication with the inlet tank and the second tube is directed vertically for communication with the outlet tank.

* * * * *